United States Patent [19]

McAllister et al.

[11] 4,258,446

[45] Mar. 31, 1981

[54] INFANT BASSINET AND CRIB ROCKER

[76] Inventors: Irvin L. McAllister, 2635 Seville Blvd., Apt. 211, Clearwater, Fla. 33520; Richard F. Wagoner, 845 Hartford Dr., Springfield, Ohio 45503

[21] Appl. No.: 73,847

[22] Filed: Sep. 10, 1979

[51] Int. Cl.[3] ..... A47D 9/02

[52] U.S. Cl. ..... 5/109; 5/105

[58] Field of Search ..... 5/60, 105, 108, 109

[56] References Cited

U.S. PATENT DOCUMENTS

| | | | |
|---|---|---|---|
| 1,733,115 | 10/1929 | Capito et al. | 5/109 |
| 1,795,246 | 3/1931 | Brown | 5/109 |
| 2,961,666 | 11/1960 | Fingel | 5/109 |
| 3,619,826 | 11/1971 | Lizotle, Sr. | 5/109 |
| 3,653,080 | 4/1972 | Hafele | 5/108 |

*Primary Examiner*—Casmir A. Nunberg
*Attorney, Agent, or Firm*—Stanley M. Miller

[57] ABSTRACT

A motorized infant rocking device is disclosed which will rock an infant resting in an infant seat or crib in a soothing manner for a predetermined period of time. In a first embodiment, the apparatus includes a track mounted to a stationary base and a glide mechanism mounted to a support beam which slidably engages the track. A rotary motor is mounted to the support beam and includes an eccentric which operatively engages a drive surface mounted to the stationary base, to impart oscillating linear motion to the support beam. An infant holding device such as an infant seat or crib is mounted to the support beam and undergoes linear oscillatory motion with respect to the base in response to the operation of the motor. In a second embodiment, rollers are mounted to a stationary base and glide rails rollably engage the rollers. A rotary motor is mounted to the base and has an eccentric which is operatively connected to the glide rails, to impart oscillating linear motion to the glide rails along the rollers. An infant holding device such as an infant seat or crib is mounted to the glide rails and undergoes linear oscillating motion with respect to the base in response to the operation of the motor. The resulting smooth oscillatory motion has a soothing effect on an infant seated in the holding device.

18 Claims, 7 Drawing Figures

FIG. 1
SEC. 1-1'
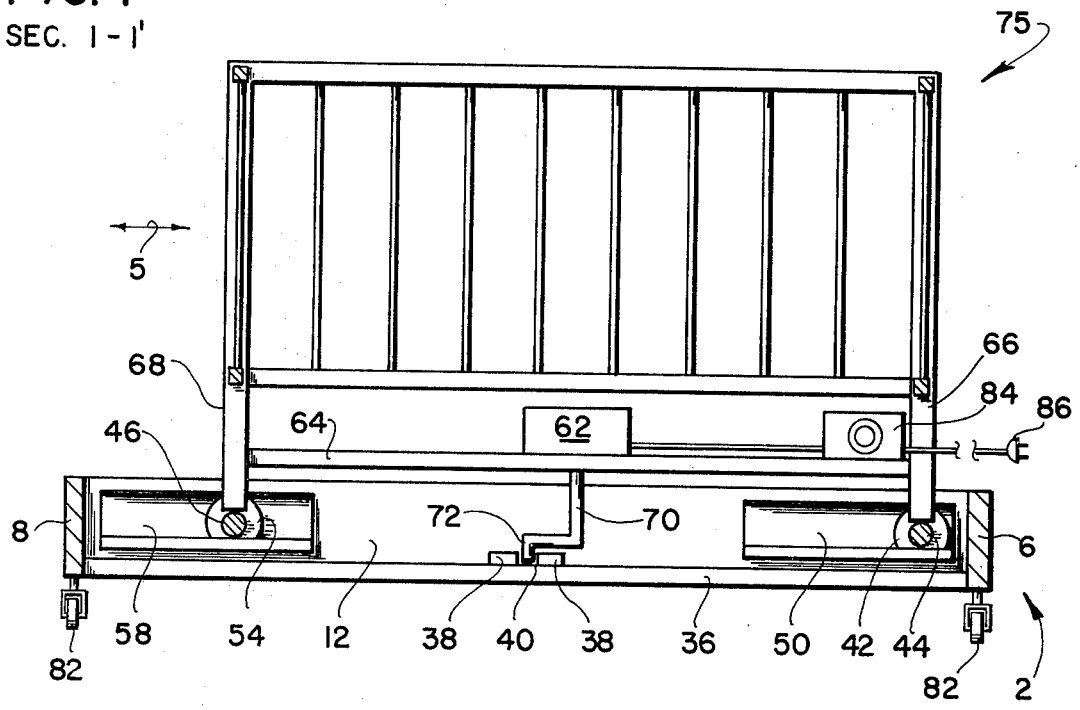
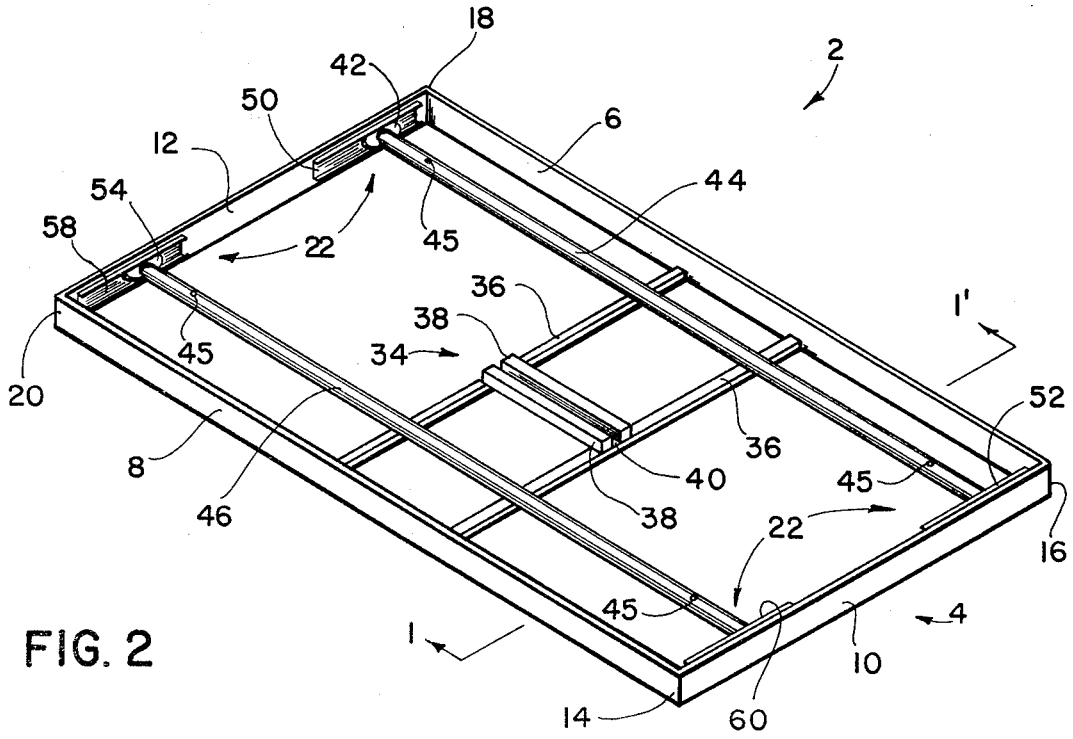
FIG. 2

INFANT BASSINET AND CRIB ROCKER

FIELD OF THE INVENTION

The invention disclosed broadly relates to infant furniture and more particularly relates to motorized infant rocking devices.

BACKGROUND OF THE INVENTION

Lateral rocking motion has a soothing, soporific effect on an infant. It has been proposed that gentle rocking motion stimulates the infant's prenatal recollection of the comforts of the womb. The practice of rocking an infant has its roots in pre-history with papoose slings and shoulder cradles being a part of the child rearing practices of early Eurasian and pre-Columbian cultures. In its more modern form the child's bed in the form of a cradle is slung upon pivots or mounted upon rockers. In its oldest forms the cradle was an oblong long box without a lid and originally, the rockers appear to have been detachable. However, like all other pieces of furniture, it has been subjected to changes of fashion as to its shape and decoration. Fourteenth century French miniature paintings show an infant sleeping in a tiny four-post bed slung upon arcuate rockers. In the Eighteenth century, cradles were often very elaborate, with richly carved and upholstered examples even being used for purposes of state. Later, they became lighter and simpler and eventually were replaced by the modern barred crib. In earlier times when the extended family included grandparents and many older children who were resident in the same household and when household servants were more common, there were a sufficient number of extra hands available to assist in rocking and otherwise care for the infant while his mother attended to other household chores. Modern times, however, have reduced the incidence of the extended family or servants living in the household, so that any rocking of the infant to soothe and quiet him must be shared among fewer family members and, of necessity, the amount of this beneficial service to the infant has diminished.

OBJECTS OF THE INVENTION

It is therefore an object of the invention to provide a motorized infant rocking device.

It is another object of the invention to provide a motorized device for rocking an infant seat.

It is still a further object of the invention to provide a motorized device for rocking an infant crib.

SUMMARY OF THE INVENTION

These and other objects, features and advantages of the invention are accomplished by the infant rocking device disclosed herein. A motorized infant rocking device is disclosed which will rock an infant resting in an infant seat or crib in a soothing manner for a predetermined period of time. In a first embodiment, the apparatus includes a track mounted to a stationary base and a glide mechanism mounted to a support beam which slidably engages the track. A rotary motor is mounted to the support beam and includes an eccentric which operatively engages a drive surface mounted to the stationary base, to impart oscillating linear motion to the support beam. An infant holding device such as an infant seat or crib is mounted to the support beam and undergoes linear oscillatory motion with respect to the base in response to the operation of the motor. In a second embodiment, rollers are mounted to a stationary base and glide rails rollably engage the rollers. A rotary motor is mounted to the base and has an eccentric which is operatively connected to the glide rails, to impart oscillating linear motion to the glide rails along the rollers. An infant holding device such as an infant seat or crib is mounted to the glide rails and undergoes linear oscillating motion with respect to the base in response to the operation of the motor. The resulting smooth oscillatory motion has a soothing effect on an infant seated in the holding device.

DESCRIPTION OF THE FIGURES

These and other objects, features and advantages of the invention will be more fully appreciated with reference to the accompanying figures.

FIG. 1 is an end view of a first embodiment of the infant rocking device with a crib mounted thereon, along section 1—1' of FIG. 2.

FIG. 2 is an isometric view of the first embodiment of the infant rocking device, without the crib mounted thereon.

DISCUSSION OF THE PREFERRED EMBODIMENT

Figure 4:
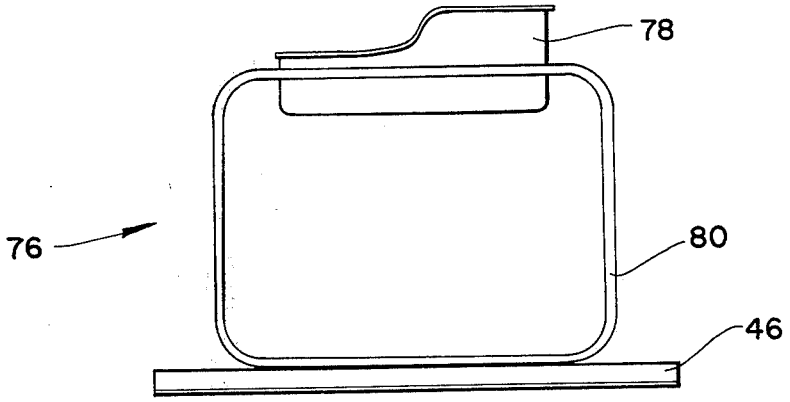
FIG. 4 is a side view of a conventional infant seat mounted on the first embodiment of the infant rocking device.
Figure 5:
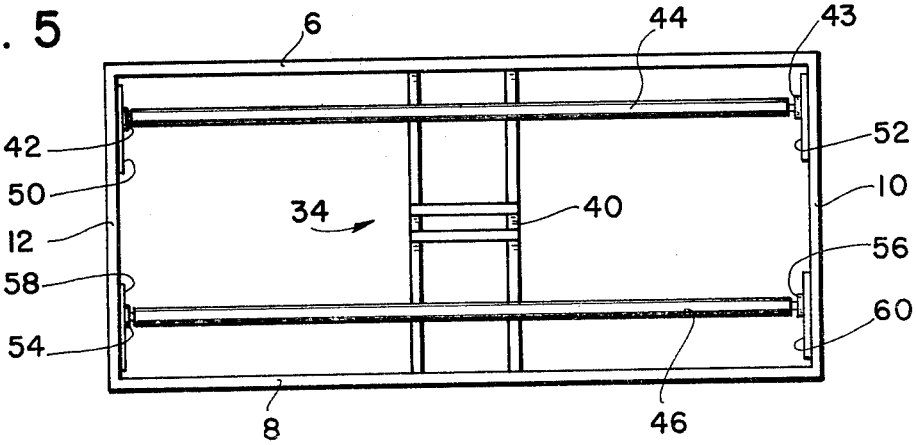
FIG. 5 is a top view of the first embodiment of the infant rocking device.
Figure 6:
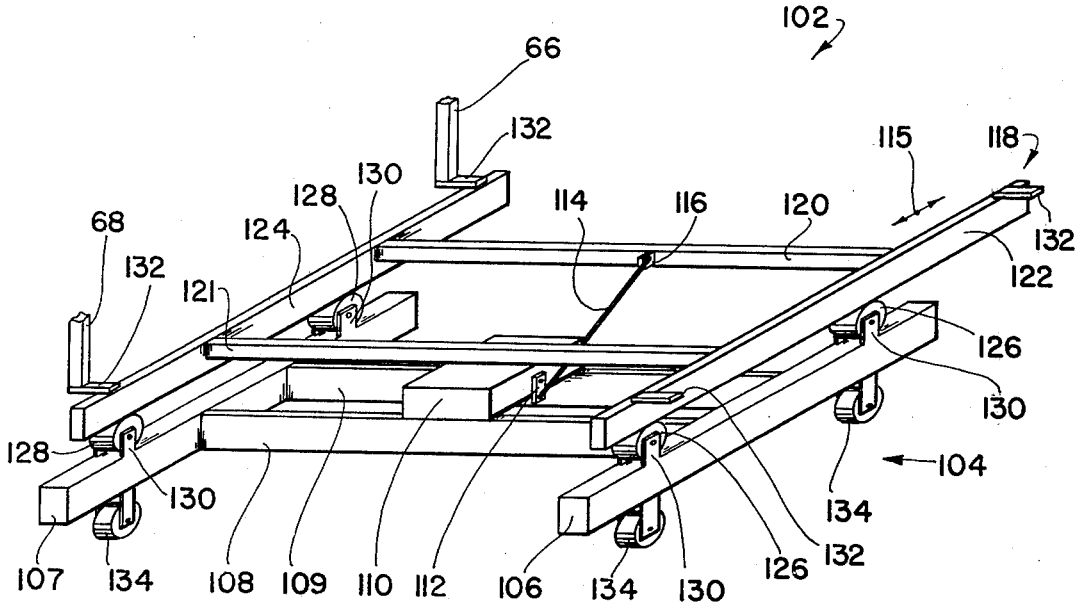
FIG. 6 is an isometric view of a second embodiment of the infant rocking device.
Figure 7:
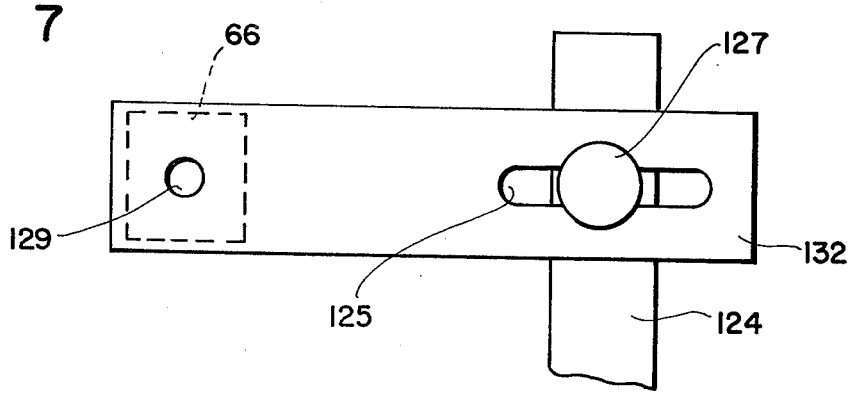
FIG. 7 is a top view of the crib mounting bracket for the second embodiment of the infant rocking device.

The infant rocking device is shown in two embodiments, the first being illustrated in FIGS. 1–5 and the second being illustrated in FIGS. 6 and 7.

Figure 3:
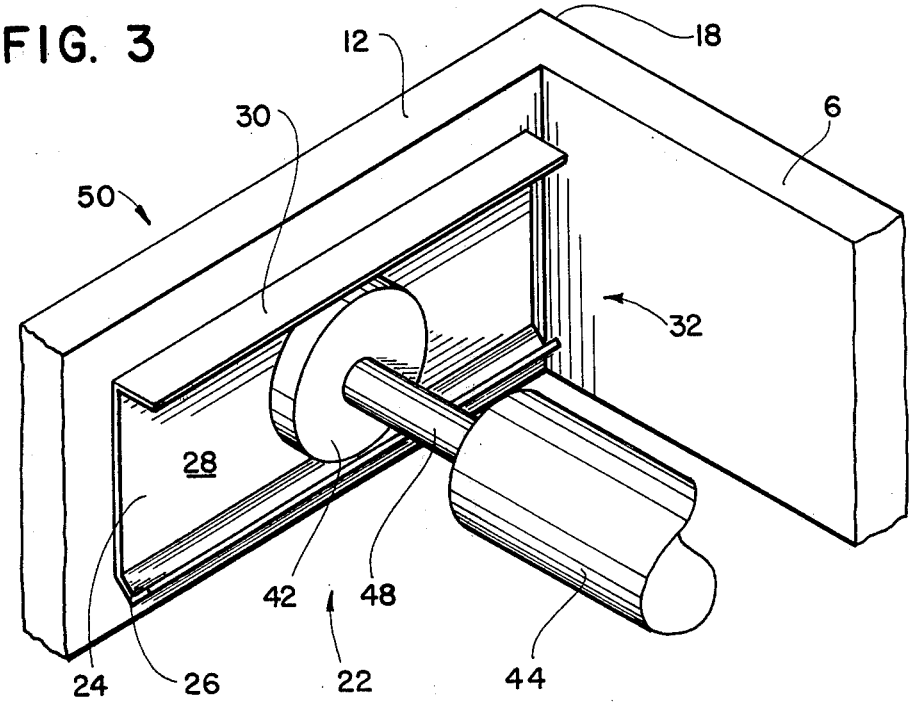
FIG. 3 is a more detailed isometric view of the track for the first embodiment of the infant rocking device.

The first embodiment of the infant rocking device is shown in overall side view in FIG. 1, showing an end view of the headboard of a conventional barred crib 75 supported by the infant rocking device 2. A track means 22, shown to better advantage in FIG. 3, is mounted to a stationary base 4, shown to better advantage in FIG. 2. A drive surface 34, seen in the top view of FIG. 5, is mounted to the stationary base 4. Two support beams 44 and 46 are each mounted at their respective ends to a pair of wheels which respectively, rollably engage a corresponding pair of linear tracks 50, for example. The wheels 42, for example, constitute a glide means which rollably engages the respective tracks 50, for example, which constitute the track means 22. A rotary drive means 62, which may be an electric motor, is mounted to the support beams 44 and 46, as illustrated in FIG. 1. An eccentric 70 is rotatably mounted to the rotary drive means 52 and operatively engages the drive surface 34 of the stationary base 4, to impart oscillating linear motion 5 of the glide means 42 in the track means 22. An infant holding device, such as the barred crib shown in FIG. 1 or the infant seat shown in FIG. 4, is mounted to the support beams 44 and 46. The infant holding device will undergo linear oscillatory motion 5 with respect to the base 4 in response to the operation of the rotary drive means 62. The resultant, smooth regular motion will soothe an infant resting in the infant holding device.

FIG. 2 gives a better view of the stationary base 4. It comprises a rectangular frame disposed in a horizontal plane, which is formed from a first pair of parallel, relatively long members 6 and 8 which are perpendularly joined at their respective ends to a second pair of parallel relatively short members 10 and 12, forming four right angle verticies, 14, 16, 18 and 20. The sharp cornered rectangular shape for the base shown in FIG. 2 can be modified to be a rectangle having quarter-circular corners, such as would be achieved in a structure made from smoothly bent aluminum tubing.

The track means 22 is shown in FIG. 2 and in more detail in FIG. 3. Four linear track brackets are employed as is shown in FIG. 2, bracket 50 being located at vertex 18, bracket 52 being located at vertex 16, bracket 60 being located at vertex 14, and bracket 58 being located at vertex 20. Each of the brackets is identical and will be illustrated in a detailed view of bracket 50 shown in FIG. 3. The structure 24 of bracket 50 is mounted horizontally at the vertex 18 of the stationary base 4 so as to be parallel with the short members 10 and 12. Each linear bracket of structure 24 has a substantially c-shaped cross section formed of a top surface 30, a back surface 28, and a grooved bottom surface 26. The c-shaped cross section has an open portion 32 which faces inwardly in the rectangular frame of the stationary base 4.

As may be seen in FIG. 2, each of the support beams 44 and 46 is parallel with the long members 6 and 8 of the stationary base 4.

The glide means 42 is illustrated in the FIGS. 1, 2 and 3. Each of a first pair of wheels 42 and 43 is rotatably mounted on a respective end of the first linear support beam 44. The wheels 42 and 43 are mounted with their spin axis 48 parallel to the support beam 44. The wheels 42 and 43 respectively engage respective ones of a corresponding first pair of c-shaped linear brackets 50 and 52 through their respective openings 32 therein. Each of a second pair of wheels 54 and 56 is rotatably mounted on respective ends of the second linear support beam 46, with their spin axes parallel thereto. The wheels 54 and 56 respectively engage the respective ones of the corresponding second pair of c-shaped linear brackets 58 and 60 through the openings 32 therein. In the preferred embodiment, the wheels 42, 43, 54 and 56 are composed of nylon.

As may be seen in FIGS. 1, 2 and 5, the drive surface 34 comprises a pair of tie members 36 which are mounted between the first pair of long members 6 and 8 of the stationary base 4. A pair of horizontal bars 38 are mounted to the tie members 36, forming a slot 40 having opposed sides parallel with the long members 6 and 8.

As may be seen in FIG. 1, a cross bar 64 is mounted between the legs 68 of the barred crib 75. In an alternate embodiment, the cross bar 64 may be mounted directly to the first and second linear beams 44 and 46. The rotary drive motor 62 is then mounted on the cross bar 64. The eccentric 70, in the form of a crank, which is mounted to the rotary motor 62, has its opposed end 72 operatively engaging slot 40 of the drive surface 34. The electric rotary motor 62 may be connected through a timer switch 84 to an electrical power source 86, so as to impart the desired linear oscillatory motion 5 to the crib 75 or the infant seat 76 for a predetermined period of time.

When the infant holding device is the crib 75, its legs 66 and 68, as shown in FIG. 1, are mounted in pairs to respective ones of the first and second linear support beams 44 and 46. If the infant holding device is the infant seat 76 shown in FIG. 4, its base 80 is mounted to the first and second linear support beams 44 and 46 and a conventional, plastic infant seat 78 is mounted on top of the base 80 as shown in FIG. 4. As may be seen in FIG. 1, the rectangular base frame 4 may have floor rollers 82 mounted thereto to enable moving the assembly. Holes 45 may be provided in the linear support beams 44 and 46 to facilitate the mounting of the crib 75 or infant seat 76 thereon.

The second embodiment of the infant rocker invention is shown in FIGS. 6 and 7. A stationary base 104 consists of a first base beam 106 and a second base beam 107 which are mutually parallel and maintained in spaced relationship by means of the cross beams 108 and 109. A rotary motor 110 is mounted on the cross beams 108 and 109 and has an eccentric crank 112 mounted thereon. A pair of rollers 126 are mounted by means of the respective pairs of brackets 130 to the first base beam 106, and have their spin axes perpendicular to the length of the base beam 106. Correspondingly, the pair of rollers 128 are mounted by means of their respective brackets 130 to the base beam 107. A first glide rail 118 lies upon the pair of rollers 126, rollably engaging same. A second glide rail 124 lies upon the pair of rollers 128 and rollably engages same. The first and second glide rails 122 and 124 constitute the glide means 118, and are maintained in a parallel spaced relationship by means of the connecting members 120 and 121. The brackets 130 may be extended vertically to guide the glide rails 122 and 124 along their respective rollers 126 and 128, respectively.

The eccentric crank 112 is operatively connected by means of the rod 114 and pivot 116 to the connecting member 120 of the glide rail means 118. As the rotary electric motor 110 operates, it imparts an oscillating linear motion 115 to the glide rail means 118 along the rollers 126 and 128, by means of the crank 112, connecting rod 114 and pivot 116.

An infant holding device such as the barred crib 75 of FIG. 1 can have its legs 66 and 68 mounted to the glide rail 124 as shown in FIG. 6. Alternately, the infant seat 76 of FIG. 4 may have its base 80 mounted to the glide means 118 in FIG. 6. The infant holding device will undergo a soothing linear oscillatory motion 115 with respect to the base 104, in response to the operation of the drive motor 110.

FIG. 7 illustrates a bracket plate 132, four of which are employed as is shown in FIG. 6, to mount the crib 75 or the infant seat 76 to the glide rail means 118. The bracket plate 132 is mounted between the glide rail 24, for example, and the leg 66 (shown in phantom outline), for example, of the barred crib 75. The bracket plate 132 has an adjustment slot 125 therein through which a mounting bolt 127 passes so as to mount the plate 132 to the glide rail 124. The leg 66 of the crib 75 is mounted to the plate 132 by means of a bolt which passes through the hole 129 of the plate 132 and into the leg 66 of the crib 75. In this manner, the plate 132 may be adjusted by sliding a bolt 127 in the slot 125 so as to enable the mounting of any size crib 75 to the glide rail means 118. The base 80 of the infant seat 76 shown in FIG. 4 may be mounted to the glide rail means 118 of FIG. 6 by means of the bracket shown in FIG. 7, in the same manner as was described above for the crib 75.

As may be seen from FIG. 6, the base 104 may have floor rollers 134 mounted thereon to enable moving the assembly. Further, the rotary electric motor 110 can be connected through a timer switch to an electrical power source, in a manner similar to the first embodiment described above, to enable imparting the soothing linear oscillatory motion for predetermined period of time.

The resultant infant rocking invention provides an easy means for imparting a soothing linear rocking motion to an infant resting in a crib or infant seat mounted thereon.

Although specific embodiments of the invention have been described above, it will be understood by those having skill in the art that changes can be made in the detailed structure and operation of these embodiments without departing from the spirit and the scope of the invention. For example, both the first and the second embodiments can have their structural members made of smoothly bent aluminum tubing, for example, to reduce the incidence of sharp corners.

What is claimed is:

1. An infant rocker, comprising:

a track means mounted to a stationary base;

a drive surface mounted to said stationary base, comprising a pair of parallel, horizontal bars having mutually opposed, proximate surfaces forming a slot therebetween;

a glide means mounted to a support beam means, rollably engaging said track means;

a rotary drive means mounted to said support beam means, having a drive shaft oriented vertically with respect to said horizontal bars;

an eccentric rotatably mounted to said rotary drive means, operatively engaging said drive surface, to impart oscillating linear motion of said glide means in said track, comprising a crank having a driven shaft portion which is a vertical extension of said vertical drive shaft and an eccentric portion which is a vertical shaft integrally mounted to said driven shaft portion and horizontally displaced therefrom, said eccentric shaft projecting vertically into said slot formed between said pair of horizontal bars and being driven against respective ones of said mutually opposed, proximate surfaces thereof, causing said rotary drive means and said support beam means to which said drive means is mounted, to undergo horizontal, oscillatory displacements;

an infant holding device mounted to said support beam means, undergoing linear oscillatory motion with respect to said base in response to the operation of said drive means.

2. The apparatus of claim 1, wherein said stationary base further comprises:

a rectangular frame disposed in a horizontal plane, formed from a first pair of parallel, relatively long members perpendicularly joined at their respective ends to a second pair of parallel, relatively short members, forming four verticies.

3. The apparatus of claim 2, wherein said track means further comprises:

four linear brackets, each mounted horizontally at a respective one of said verticies of said rectangular frame, parallel with said short members, each having a substantially c-shaped cross-section with an open portion facing inwardly in said frame.

4. The apparatus of claim 3, wherein said support beam means further comprises:

first and second linear beams, each parallel with said long members.

5. The apparatus of claim 4, wherein said glide means further comprises:

a first pair of wheels, each rotatably mounted on a respective end of said first linear beam with their spin axis parallel thereto, for respectively rollably engaging a corresponding first pair of said c-shaped linear brackets through said openings therein:

a second pair of wheels, each rotatably mounted on a respective end of said second linear beam with their spin axis parallel thereto, for respectively rollably engaging a corresponding second pair of said c-shaped linear brackets through said openings therein.

6. The apparatus of claim 5, wherein said wheels are composed of nylon.

7. The apparatus of claim 5, wherein said drive surface further comprises:

a tie member mounted between said first pair of long members;

said pair of horizontal bars mounted to said tie member, forming said slot having opposed sides parallel with said long members.

8. The apparatus of claim 7, wherein said infant holding device is a crib whose legs are mounted in pairs to a respective one of said first or second linear beams.

9. The apparatus of claim 7, wherein said infant holding device is an infant seat whose base is mounted to said first and second linear beams.

10. The apparatus of claim 7, wherein said rectangular frame has floor rollers mounted thereto.

11. The apparatus of claim 7, wherein said rotary drive means further comprises:

an electric motor connected through a timer switch to an electrical power source.

12. An infant rocker, comprising:

roller means mounted to a stationary base;

glide rail means rollably engaging said roller means;

rotary drive means mounted to said base;

an eccentric rotatably mounted to said rotary drive means, operatively connected to said glide rail means, to impart oscillating linear motion to said glide rail means along said roller means;

an infant holding device mounted to said glide rail means, undergoing linear oscillatory motion with respect to said base in response to the operation of said drive means;

a bracket plate mounted between said glide rail means and said infant holding device, having an adjustment slot therein through which a mounting bolt passes to mount said plate to said glide rail means;

whereby said plate may be adjusted to mount to said infant holding device.

13. The apparatus of claim 12, wherein said infant holding device is an infant seat whose base is mounted to said bracket plate.

14. The apparatus of claim 13, wherein said base has floor rollers mounted thereto.

15. The apparatus of claim 14, wherein said rotary drive means further comprises:

an electric motor connected through a timer switch to an electrical power source.

16. The apparatus of claim 12, wherein said infant holding device is a crib each of whose legs is mounted to one of a plurality of said bracket plates.

17. The apparatus of claim 16, wherein said base has floor rollers mounted thereto.

18. The apparatus of claim 17, wherein said rotary drive means further comprises:

an electric motor connected through a timer switch to an electrical power source.

* * * * *